US010073382B2

(12) United States Patent
Kihara et al.

(10) Patent No.: US 10,073,382 B2
(45) Date of Patent: Sep. 11, 2018

(54) IMAGE FORMING APPARATUS THAT APPLIES BIAS VOLTAGE ACCORDING TO STORED IMAGE BEARING MEMBER INFORMATION

(71) Applicant: CANON KABUSHIKI KAISHA, Tokyo (JP)

(72) Inventors: Takayoshi Kihara, Mishima (JP); Yusaku Iwasawa, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/264,020

(22) Filed: Sep. 13, 2016

(65) Prior Publication Data

US 2017/0075263 A1 Mar. 16, 2017

(30) Foreign Application Priority Data

Sep. 16, 2015 (JP) ..... 2015-182746

(51) Int. Cl.
*G03G 15/16* (2006.01)

(52) U.S. Cl.
CPC ... *G03G 15/161* (2013.01); *G03G 2215/1661* (2013.01)

(58) Field of Classification Search
CPC ..... G03G 2215/1661; G03G 15/161
See application file for complete search history.

(56) References Cited

U.S. PATENT DOCUMENTS

| | | | | |
|---|---|---|---|---|
| 9,342,033 | B2 | 5/2016 | Hasegawa et al. | |
| 2009/0232530 | A1 | 9/2009 | Saito et al. | |
| 2013/0279934 | A1* | 10/2013 | Hasegawa | G03G 21/10 399/71 |
| 2016/0062276 | A1* | 3/2016 | Fujimoto | G03G 21/0064 399/71 |

FOREIGN PATENT DOCUMENTS

| | | | |
|---|---|---|---|
| JP | H11161043 | A | 6/1999 |
| JP | 2009205012 | A | 9/2009 |
| JP | 5645870 | B2 | 12/2014 |

* cited by examiner

*Primary Examiner* — Sevan A Aydin
(74) *Attorney, Agent, or Firm* — Rossi, Kims & McDowell LLP

(57) ABSTRACT

An image forming apparatus includes: a transfer member that secondarily transfers a developer image primarily transferred to a intermediate transfer medium, to a recording medium; a charging member that charges residual developer remaining on the intermediate transfer medium after the developer image is secondarily transferred from the intermediate transfer medium to the recording medium; and a storage portion that stores information on a image bearing member. A bias applied to the charging member is changed based on the information when the residual developer charged by the charging member is collected by being transferred from the intermediate transfer medium to the image bearing member.

15 Claims, 8 Drawing Sheets

IMAGE FORMING APPARATUS THAT APPLIES BIAS VOLTAGE ACCORDING TO STORED IMAGE BEARING MEMBER INFORMATION

BACKGROUND OF THE INVENTION

Field of the Invention

The present invention relates to an image forming apparatus which uses an electrophotographic technique.

Description of the Related Art

Conventionally, an image forming apparatus that forms a color image on a sheet using an electrophotographic technique is known. In such an image forming apparatus, toner images formed in a plurality of process cartridges are primarily transferred to an intermediate transfer belt. Moreover, the toner images primarily transferred to the intermediate transfer belt in a superimposed manner are secondarily transferred to the sheet. Moreover, the toner images secondarily transferred to the sheet are heated and pressed by a fixing apparatus whereby a color image is formed on the sheet.

Here, after the toner images are secondarily transferred from the intermediate transfer belt to the sheet, the toner particles on the intermediate transfer belt may remain thereon. The toner particles remaining on the intermediate transfer belt is referred to as residual toner particles. Moreover, a method of collecting the residual toner particles on the intermediate transfer belt by transferring the residual toner particles back to a photosensitive drum is known. Specifically, the residual toner particles on the intermediate transfer belt are charged by a residual toner charging member. Moreover, the charged residual toner particles are transferred back to the photosensitive drum at a nip portion between the photosensitive drum and the intermediate transfer belt.

Japanese Patent No. 5645870 disclosed a technique related to the residual toner collection method in which the amount of light exposed to a photosensitive drum is decreased to collect toner particles on an intermediate transfer belt. In this way, deterioration of the photosensitive drum is suppressed.

Moreover, Japanese Patent Application Publication No. 2009-205012 discloses a technique related to the residual toner collection method in which the residual toner particles on an intermediate transfer belt are uniformly scattered by a brush member before the residual toner particles are charged by a residual toner charging member. In this way, the residual toner particles on the intermediate transfer belt are uniformly charged by the residual toner charging member. All residual toner particles are transferred back to the photosensitive drum without remaining on the intermediate transfer belt.

Moreover, Japanese Patent Application Publication No. H11-161043 discloses a technique related to the residual toner collection method in which the magnitude of a voltage applied to the residual toner charging member is changed based on temperature and humidity environments. In this way, it is possible to suppress cleaning defects occurring when residual toner particles are not charged sufficiently in a high-temperature and high-humidity environment. Moreover, it is possible to suppress image defects occurring when residual toner particles are charged excessively in a low-temperature and low-humidity environment.

However, in a color image forming apparatus, the thickness (film thickness) of a photosensitive drum may be different among a plurality of process cartridges. When the photosensitive drum is thin, a large amount of current flows to a toner image of an intermediate transfer belt due to a discharge between the photosensitive drum and a primary transfer roller during primary transfer. Due to this, a charge distribution of the toner particles of the toner image on the intermediate transfer belt spreads out. That is, the amount of charges possessed by the individual toner particles of the toner image varies greatly. Toner particles having large positive charges and toner particles having large negative charges are mixed in the toner image. Moreover, the charge distribution of the toner particles on the intermediate transfer belt spreads further during secondary transfer.

SUMMARY OF THE INVENTION

Thus, in the residual toner collection method, a case in which the residual toner particles on the intermediate transfer belt are not charged sufficiently by the residual toner charging member may occur. For example, when it is desired to charge the residual toner particles to a positive polarity, a case in which toner particles having large negative charges are not charged sufficiently to the positive polarity may occur. The residual toner particles which are not charged sufficiently may remain on the intermediate transfer belt without being transferred back to the photosensitive drum. In other to solve this problem, a method of charging all residual toner particles sufficiently by increasing the voltage applied to the residual toner charging member may be considered. However, when the voltage applied to the residual toner charging member is increased, the residual toner charging member may deteriorate and the service life of the residual toner charging member may decrease.

An object of the present invention is to provide an image forming apparatus comprising:

a plurality of image bearing members on each of which a developer image is formed;

an intermediate transfer medium to which the developer image on the image bearing member is primarily transferred;

a transfer member that secondarily transfers the developer image primarily transferred to the intermediate transfer medium, to a recording medium;

a charging member that charges residual developer remaining on the intermediate transfer medium after the developer image is secondarily transferred from the intermediate transfer medium to the recording medium; and a storage portion that stores information on the image bearing member, wherein an application bias applied to the charging member is changed based on the information when the residual developer charged by the charging member is collected by being transferred from the intermediate transfer medium to the image bearing member.

According to the present invention, even when the thicknesses of a plurality of photosensitive drums are different, it is possible to collect the residual toner particles on the intermediate transfer belt with high accuracy using the photosensitive drum without sacrificing the service life of the residual toner charging member.

Further features of the present invention will become apparent from the following description of exemplary embodiments (with reference to the attached drawings).

DESCRIPTION OF THE EMBODIMENTS

Hereinafter, exemplary embodiments of the present invention will be described reference to the accompanying drawings. However, dimensions, materials, shapes, relative positions, and the like of constituent components described in the embodiment are changed appropriately according to a configuration and various conditions of an apparatus to which the present invention is applied. That is, the scope of the present invention is not limited to the following embodiments.

(First Embodiment)

A first embodiment will be described with reference to the drawings. In the present embodiment, photosensitive drums 11Y to 11K which are image bearing members have two or more types of thicknesses (film thicknesses) (the number of types of photosensitive drums 11 is two or more), and the voltage (bias) applied to an ICL roller 37 is controlled based on the thickness of the photosensitive drums 11Y to 11K. Moreover, in the present embodiment, a photosensitive drum 11 (A-drum) (first image bearing member) having a thickness of 10 μm and a photosensitive drum (B-drum) (second image bearing member) having a thickness of 25 μm are used as the image bearing members. In the present embodiment, although the two types of the first and second image bearing members are used, three or four image bearing members may be used.

<Configuration of Image Forming Apparatus>

Figure 2:
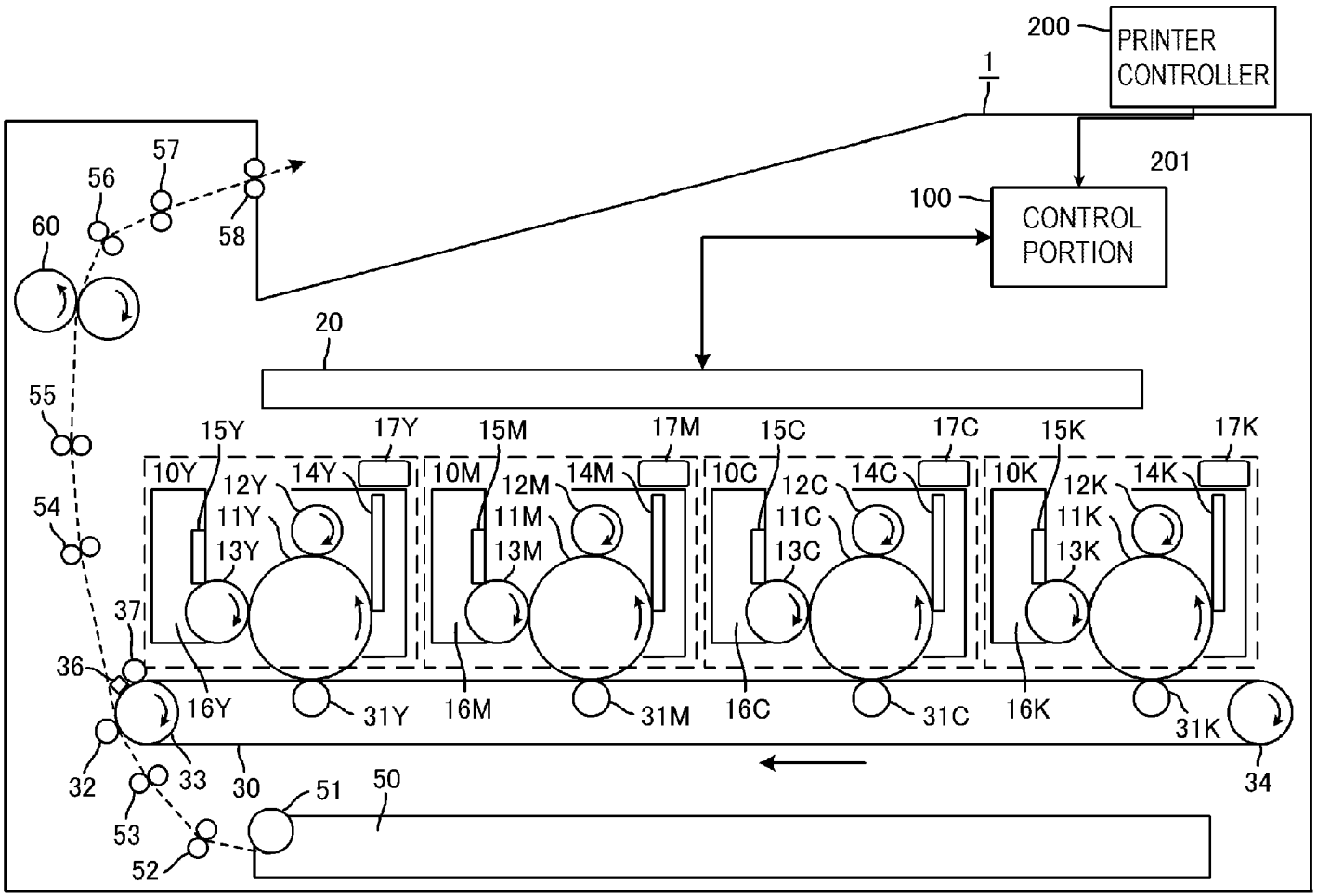
FIG. 2 is a schematic cross-sectional view of an image forming apparatus according to the first embodiment.

FIG. 2 is a schematic cross-sectional view of an image forming apparatus 1 according to the first embodiment. The image forming apparatus 1 is a laser beam printer which uses an electrophotographic technique. Image data (electrical image information) is input from a printer controller 200 (external host device) to a control portion 100 via an interface 201. Moreover, an image corresponding to the image data is formed on a sheet P (recording medium) which is a recording medium.

The control portion 100 controls the operation of the image forming apparatus 1. Moreover, the control portion 100 receives various electrical information signals from the printer controller 200 and transmits electrical information signals to the printer controller 200. Moreover, the control portion 100 controls the operations of various process devices, processing of electrical information signals input from sensors, processing of instruction signals input to various process devices, a predetermined initialization sequence, a predetermined image forming sequence, and the like. The printer controller 200 is a host computer, a network, an image reader, a facsimile, and the like, for example.

In the image forming apparatus 1 according to the first embodiment, four process cartridges 10Y, 10M, 10C, and 10K are arranged in a row at a certain interval in a lateral direction (approximately, a horizontal direction). That is, the plurality of process cartridges 10 are provided in the image forming apparatus 1. The image forming apparatus 1 is a so-called tandem-type image forming apparatus. The process cartridges 10Y to 10K have photosensitive drums 11 (11Y to 11K), charging rollers 12 (12Y to 12K), developing rollers 13 (13Y to 13K), drum cleaners 14 (14Y to 14K), and developing blades 15 (15Y to 15K). Here, the process cartridges 10Y to 10K have the same configuration except that the colors of the toner components stored therein are different. Thus, when it is not necessary to distinguish the respective process cartridges, the configuration of the process cartridges 10Y to 10K will be described collectively by omitting the suffixes Y to K.

The photosensitive drum 11 is an image bearing member on which a toner image (developer image) is formed. The charging roller 12 charges the surface of the photosensitive drum 11 uniformly to a predetermined potential. The developing roller 13 bears and conveys non-magnetic monocomponent toner (having negative charging characteristics) for developing an electrostatic latent image formed on the photosensitive drum 11 (the image bearing member). The developing blade 15 equalizes the thickness of a toner layer on the developing roller 13. The drum cleaner 14 cleans the surface of the photosensitive drum 11 after the toner image is primarily transferred from the photosensitive drum 11 to an intermediate transfer belt 30 (an intermediate transfer medium). The surface of the photosensitive drum 11 rotates at a speed of 200 (mm/sec) in a direction indicated by an arrow in FIG. 2 by a driving means (not illustrated).

Here, the process cartridges 10Y, 10M, 10C, and 10K form toner images of the colors yellow (Y), magenta (M), cyan (C), and black (K), respectively. Moreover, the process cartridges 10Y to 10K are configured to be detachably attached to the main body of the image forming apparatus 1. Thus, when the toner in the developer container 16 is consumed completely, for example, it is possible to replenish the image forming apparatus 1 with toner by replacing the process cartridges 10Y to 10K.

Moreover, a memory 17 (a storage portion) as a storage means is provided in the process cartridges 10Y to 10K. For example, a contact nonvolatile memory, a non-contact nonvolatile memory, a volatile memory with a power source, and the like can be used as the memory 17. In the present embodiment, the memory 17 which is a non-contact nonvolatile memory is mounted on the process cartridge 10 as a storage means. The memory 17 has an antenna (not illustrated) which is an information communication means. The memory 17 can read and write information by wirelessly communicating with the control portion 100 provided in the main body of the image forming apparatus 1. Naturally, the memory 17 may be a contact-type memory rather than a non-contact-type memory.

That is, the control portion 100 has an information communication means provided in the main body of the image forming apparatus 1 and a function of reading and writing information from and to the memory 17. Information on the thickness of a photosensitive layer of the photosensitive drum 11 and the sensitivity of the photosensitive drum 11 is stored in the memory 17 during manufacturing. Moreover, information on the thickness and the sensitivity of the photosensitive drum 11 changing with the use of the photosensitive drum 11 can be written and read to and from the memory 17.

The charging roller 12 which is a contact-type charging means has a cored bar and a conductive elastic layer formed on the cored bar. The axial line of the center of rotation of the charging roller 12 is approximately parallel to the axial line of the center of rotation of the photosensitive drum 1. Moreover, the charging roller 12 is in contact with the photosensitive drum 11 with predetermined pressing force while resisting the elastic force of the conductive elastic layer of the photosensitive drum 11. The cored bar of the charging roller 12 is rotatably supported by bearings (not illustrated) at both ends of the cored bar. In this way, the charging roller 12 rotates following the rotation of the photosensitive drum 11. In the present embodiment, a DC voltage of approximately −1100 V is applied to the cored bar of the charging roller 12 as a charging bias voltage.

The developing roller 13 has a cored bar and a conductive elastic layer formed on the cored bar. Moreover, the axial line of the center of rotation of the developing roller 13 is approximately parallel to the axial line of the center of rotation of the photosensitive drum 11. The developing blade 15 is formed as a thin metal plate or the like formed of SUS. The free end of the developing blade 15 is in contact with the developing roller 13 with predetermined pressing force. The developing roller 13 conveys toner particles triboelectrically charged to a negative polarity toward the photosensitive drum 11. Moreover, the developing roller 13 can be brought into contact with and be separated from the photosensitive drum 11 by a driving mechanism (not illustrated). Further, the developing roller 13 comes into contact with the photosensitive drum 11 when an image is formed. Moreover, when an image is formed, a DC bias voltage of approximately −300 V is applied to the cored bar of the developing roller 13 as a developing bias voltage.

In the image forming apparatus 1 according to the present embodiment, a laser exposure unit 20 that exposes the photosensitive drum 11 is provided in each of the process cartridges 10. Time-sequential electrical digital pixel signals of the image information processed by the control portion 100 are input to the laser exposure unit 20. Here, the image information processed by the control portion 100 is the image information input from the printer controller 200 to the control portion 100 via the interface 201.

The laser exposure unit 20 includes a laser output portion that outputs a laser beam L modulated according to the input time-sequential electrical digital pixel signals, a rotary polygon mirror, an fθ lens, a reflector, and the like. Moreover, the laser exposure unit 20 performs main scanning exposure on the surface of the photosensitive drum 11 with the laser beam L. Thus, the electrostatic latent image corresponding to the image information is formed on the surface of the photosensitive drum 11 by the main scanning exposure based on the laser beam L and the rotation of the photosensitive drum 11.

<Mechanism in which Toner Image is Transferred>

In the image forming apparatus 1 according to the present embodiment, the intermediate transfer belt 30 is disposed so as to come in contact with the photosensitive drums 11Y to 11K of the process cartridges 10Y to 10K. The intermediate transfer belt 30 has an electrical resistance (volume resistivity) of approximately $10^{11}$ to $10^{16}$ (Ω·cm) and a thickness of 100 to 200 μm. The material of the intermediate transfer belt 30 is a resin film of polyvinylidene fluoride (PVdf), nylon, polyethylene terephthalate (PET), polycarbonate (PC), and the like of which the resistance is adjusted as necessary. Moreover, in the present embodiment, the intermediate transfer belt 30 is an endless belt. The intermediate transfer belt 30 is stretched by a driving roller 34 and a secondary transfer opposing roller 33 and is driven to circulate when the driving roller 34 is rotated by a motor (not illustrated).

The primary transfer roller 31 (primary transfer member) is configured such that a foamed sponge of which the volume resistivity is adjusted to $10^7$ to $10^8$ (Ω·cm) is formed on a shaft thereof as a conductive elastic layer. Moreover, the axial line of the center of rotation of the primary transfer roller 31 is approximately parallel to the axial line of the center of rotation of the photosensitive drum 11M. The primary transfer roller 31 is in contact with the photosensitive drum 11 with a predetermined pressing force (9.8 N) with the intermediate transfer belt 30 interposed therebetween. The primary transfer roller 31 rotates following the movement of the intermediate transfer belt 30. An electric field is formed between the primary transfer roller 31 and the photosensitive drum 11 when a positive-polarity DC bias (a voltage of 1500 V) is applied to the shaft of the primary transfer roller 31.

The toner images of respective colors formed on the photosensitive drum 11 are conveyed to a position (primary transfer position) between the photosensitive drum 11 and the primary transfer roller 31 when the photosensitive drum 11 rotates further in the direction indicated by the arrow in FIG. 2. Moreover, by the primary transfer electric field formed between the primary transfer roller 31 and the photosensitive drum 11, the toner images on the photosensitive drum 11 are primarily transferred sequentially to the intermediate transfer belt 30 (the intermediate transfer medium).

In this case, the toner images of four colors are sequentially transferred to the intermediate transfer belt 30 in a superimposed manner. The toner remaining on the photosensitive drum 11 after the primary transfer is cleaned by the drum cleaner 14 (a cleaning device). In order to satisfactorily perform the primary transfer always while satisfying conditions such as high transfer efficiency and a low retransfer ratio, it is necessary to always control a positive-polarity bias applied to the primary transfer roller 31 from a primary transfer bias power source 701 to an optimal value by taking environments, characteristics of parts, and the like into consideration. This control is performed by a transfer voltage controller.

Here, a sheet cassette 50 on which sheets P are stacked is provided in the image forming apparatus 1 according to the first embodiment. The sheet P stacked on the sheet cassette 50 is fed and conveyed at a predetermined timing. Moreover, a pickup roller 51 that feeds the sheet P and a conveying roller 52 that conveys the fed sheet P are also provided. Further, a registration roller 53 that conveys the sheet P to a position (secondary transfer position) between the intermediate transfer belt 30 and a secondary transfer roller 32 which is a secondary transfer member in synchronization with forming of a toner image is also provided in the image forming apparatus 1.

When the toner images of the four colors are primarily transferred to the intermediate transfer belt 30, the sheet P is conveyed to the secondary transfer position by the registration roller 53 in synchronization with rotation of the intermediate transfer belt 30. The secondary transfer roller 32 has the same configurations as the primary transfer roller 31 and presses the sheet P toward the intermediate transfer belt 30. Moreover, the toner images of the four colors on the intermediate transfer belt 30 are secondarily transferred to the sheet P collectively when a positive-polarity bias is applied from a secondary transfer bias power source 702 to the secondary transfer roller 32.

The secondary transfer roller 32 has a roller form and is configured such that a foamed sponge of which the volume resistivity is adjusted to $10^7$ to $10^8$ (Ω·cm) is formed on a shaft thereof as a conductive elastic layer. Moreover, the secondary transfer roller 32 is in contact with the intermediate transfer belt 30 with predetermined pressing force (50 N) and rotates following the movement of the intermediate transfer belt 30. When the toner image on the intermediate transfer belt 30 is secondarily transferred to the sheet P, a voltage of +2500 V is applied to the secondary transfer roller 32.

<Mechanism in which Intermediate Transfer Belt is Cleaned>

Figure 3:
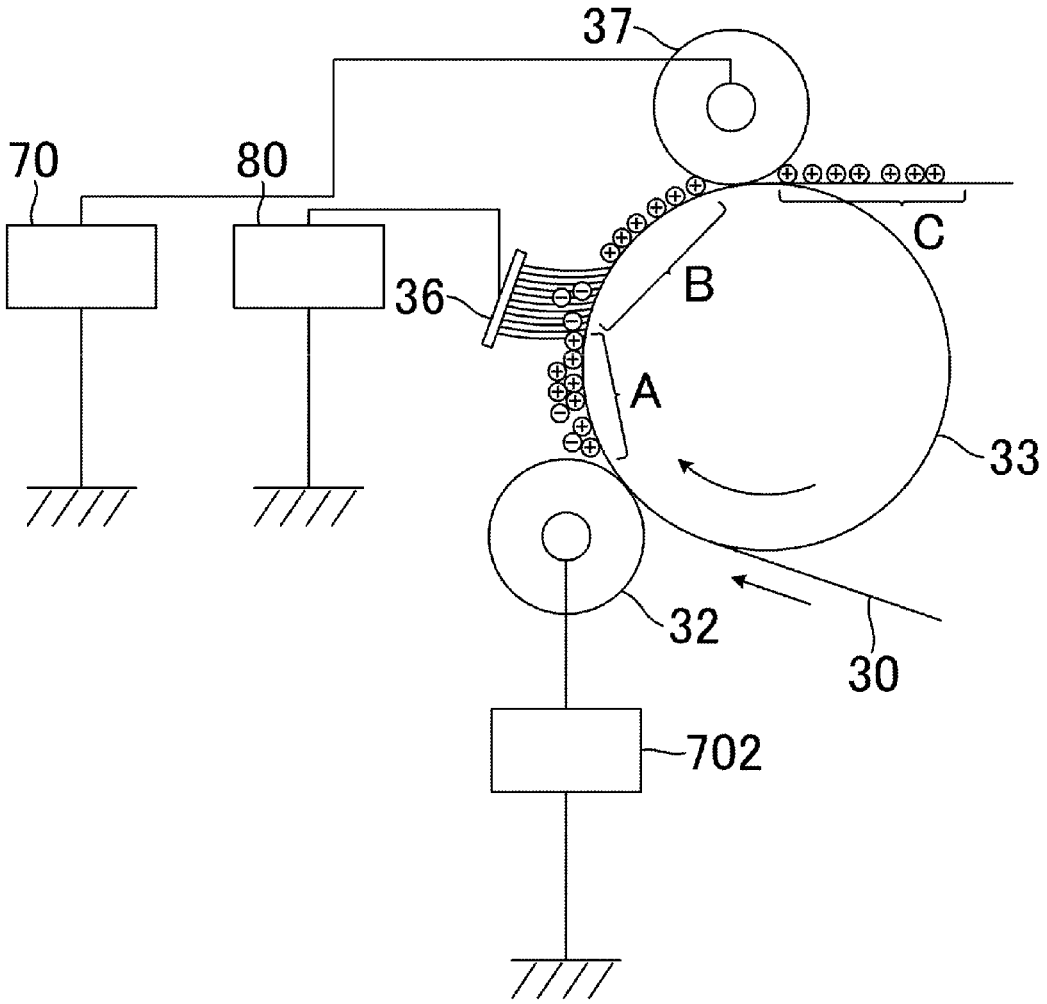
FIG. 3 is a diagram illustrating how residual developer particles are charged by a residual developer charging member.

FIG. 3 is a diagram illustrating how the toner particles remaining on the intermediate transfer belt 30 are charged by the ICL roller 37 (charging member). As illustrated in FIG. 3, secondary transfer residual toner particles (residual developer particles) which are toner particles remaining on the intermediate transfer belt 30 after the secondary transfer are charged to both positive and negative polarities by being influenced by the positive-polarity voltage applied to the secondary transfer roller 32. Moreover, as indicated by symbol "A" in FIG. 3, the secondary transfer residual toner particles remain on the intermediate transfer belt 30 by forming a plurality of layers in a local area by being influenced by the unevenness of the surface of the sheet P.

A conductive brush 36 positioned closer to the upstream side than the ICL roller 37 in the moving direction of the intermediate transfer belt 30 is disposed to enter into the intermediate transfer belt 30 by a predetermined amount. As a result, as indicated by symbol "B" in FIG. 3, the secondary transfer residual toner particles deposited on the intermediate transfer belt 30 as a plurality of layers mechanically become approximately one layer due to a difference between the circumferential velocities of the conductive brush 36 and the intermediate transfer belt 30 in the course of passing through the conductive brush 36. Moreover, a positive-polarity voltage is applied from a high-voltage power source 80 to the conductive brush 36. The conductive brush 36 is controlled (constant-current-controlled) whereby the secondary transfer residual toner particles are charged to a polarity (positive polarity) opposite to the polarity of the toner particles when the electrostatic latent image is developed in the course of passing through the conductive brush 36. Moreover, negative-polarity toner particles which are not charged to the positive polarity are collected by the conductive brush 36. In this manner, the conductive brush 36 which is a conductive member has a function of dispersing the developer to thin the layer of developer and a function of charging the developer.

After that, the secondary transfer residual toner particles having passed through the conductive brush 36 are conveyed toward the ICL roller 37 with the movement of the intermediate transfer belt 30. A positive-polarity voltage (1500 V) is applied from a roller high-voltage power source 70 to the ICL roller 37. Moreover, the secondary transfer residual toner particles charged to the positive polarity by the conductive brush 36 are further charged in the course of passing through the ICL roller 37. In this way, as indicated by symbol "C" in FIG. 3, positive charges optimal for transferring the secondary transfer residual toner particles on the intermediate transfer belt 30 back to the photosensitive drum 11 can be applied to the secondary transfer residual toner particles.

The secondary transfer residual toner particles to which optimal charges are applied are transferred back to the photosensitive drum 11Y by the electric field between the photosensitive drum 11Y and the primary transfer roller 31Y when a positive-polarity voltage is applied to the primary transfer roller 31Y. The secondary transfer residual toner particles transferred back to the photosensitive drum 11Y are collected by the drum cleaner 14Y. The toner particles collected by the conductive brush 36 and the toner particles attached to the ICL roller 37 are periodically discharged by a backward rotation operation executed after an image forming operation ends. Here, the backward rotation operation is an operation of rotating the photosensitive drum 11 continuously for a predetermined period after the image forming operation ends.

In the present embodiment, the ICL roller 37 is disposed on the downstream side of the conductive brush 36 in the moving direction of the intermediate transfer belt 30. A charge amount of the secondary transfer residual toner particles often changes depending on the environment (temperature, humidity, or the like) when secondary transfer is performed, a charge amount of toner particles primarily transferred to the intermediate transfer belt 30, the type of a recording medium, and the like. The charging member such as the ICL roller 37 is formed of a conductive elastic layer of which the resistance is adjusted. However, when a current is continuously applied to the ICL roller 37, the ICL roller 37 may deteriorate and the service life of the image forming apparatus may decrease. Thus, the voltage applied to the ICL roller 37 is preferably controlled to a bias value (voltage value) as low as necessary.

The sheet P to which the toner images of the four colors are transferred is conveyed to the fixing apparatus 60 by a conveying roller 54 and a conveying roller 55. The non-fixed toner image transferred to the sheet P is fixed to the sheet P by being heated and pressed by the fixing apparatus 60. After that, the sheet P to which the toner image is fixed is discharged to a discharge tray disposed on the upper surface of the image forming apparatus 1 by a conveying roller 56, a conveying roller 57, and a discharge roller 58.

<High-Voltage Power Source Circuit of Image Forming Apparatus>

Figure 4:
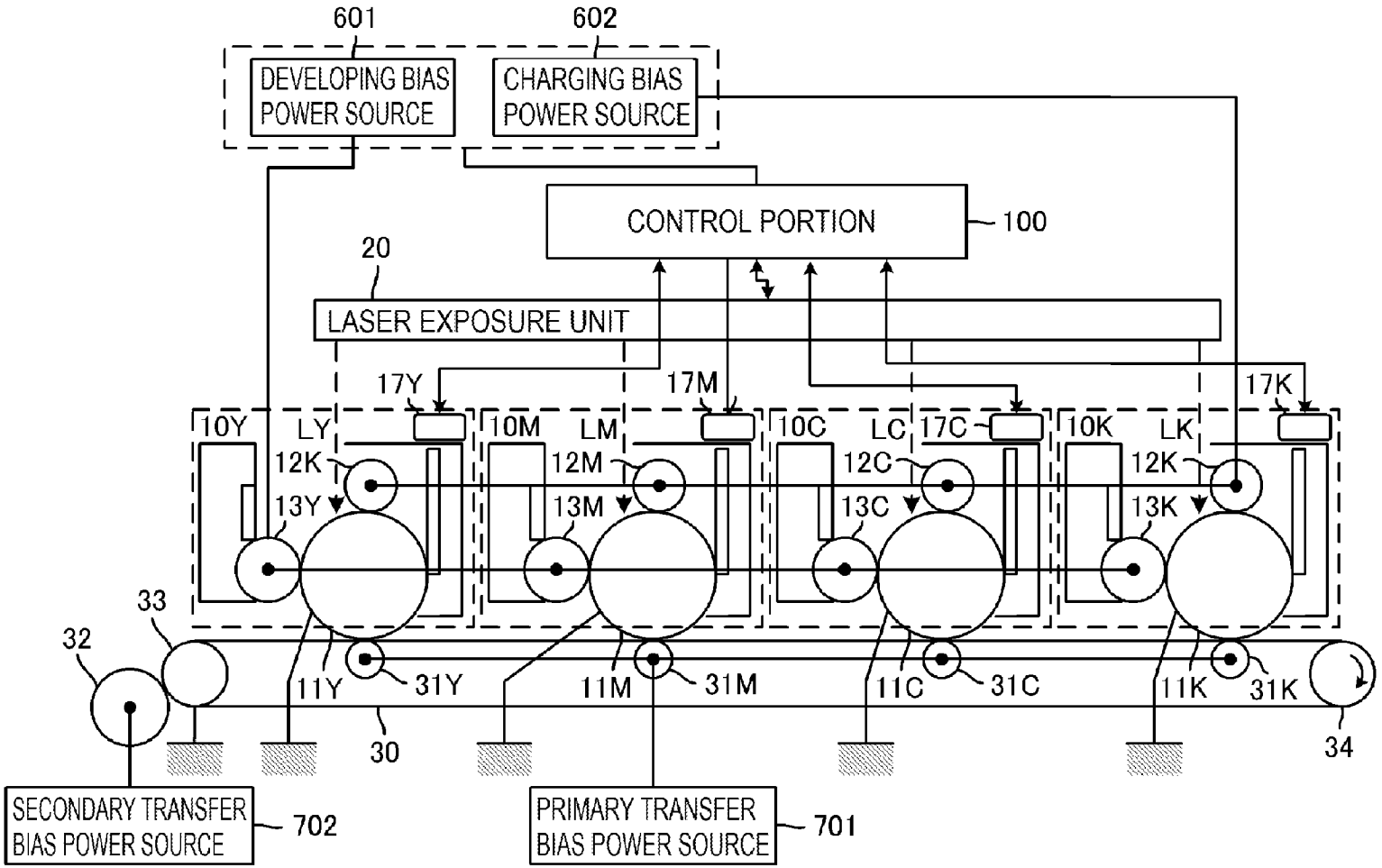
FIG. 4 is a diagram illustrating an electric circuit of the image forming apparatus according to the first embodiment.

FIG. 4 is a diagram illustrating a high-voltage power source of the image forming apparatus 1 according to the first embodiment. As illustrated in FIG. 4, a charging bias power source 602 is connected to the charging rollers 12Y to 12K of the process cartridges 10Y to 10K. That is, a charging bias is applied from the same charging bias power source 602 to the charging rollers 12Y to 12K. Thus, a charging bias of the same value is applied to the charging rollers 12Y to 12K. Moreover, a developing bias power source 601 is connected to the developing rollers 13Y to 13K of the process cartridges 10Y to 10K. In this case, a developing bias is applied from the same developing bias power source 601 to the developing rollers 13Y to 13K. Thus, a developing bias of the same value is applied to the developing rollers 13Y to 13K.

Similarly, a transfer bias is applied from the same primary transfer bias power source 701 to the primary transfer rollers 31Y to 31K of the process cartridges 10Y to 10K. Thus, a transfer bias of the same value is applied to the primary transfer rollers 31Y to 31K. Moreover, a transfer bias is applied to the primary transfer roller 31 via a high-voltage transformer (not illustrated). In this manner, in the image forming apparatus 1 of the present embodiment, a voltage is applied from the same high-voltage power source to the primary transfer rollers 31Y to 31K of the process cartridges 10Y to 10K. Thus, it is possible to decrease the number of power sources and to reduce the size and the cost of the image forming apparatus 1.

<Problems Caused by Secondary Transfer Residual Toner Particles>

As described above, when the power source that applies a transfer bias to the primary transfer roller 31 is integrated into the primary transfer bias power source 701, a transfer bias of the same value only can be applied to the primary transfer rollers 31Y to 31K. Here, the transfer bias is set depending on the resistance of the intermediate transfer belt 30, the environment (temperature and humidity), the number of passing sheets, and the like so that the toner image on the photosensitive drum 11 can be transferred to the intermediate transfer belt 30 most efficiently.

However, when the thicknesses of the photosensitive drum 11Y to 11K of the process cartridges 10Y to 10K are different, the current flowing due to a discharge between the primary transfer roller 31 and the photosensitive drum 11 has an influence on the charges of the toner particles on the photosensitive drum 11. When the photosensitive drum 11 is thin, the amount of current flowing to the toner image due to a discharge between the primary transfer roller 31 and the photosensitive drum 11 is larger than that when the photosensitive drum 11 is thick. Thus, when a voltage is applied to the primary transfer roller 31 using the thick photosensitive drum 11 as a reference, the amount of current flowing due to a discharge between the primary transfer roller 31 and the thin photosensitive drum 11 increases.

Thus, when the photosensitive drum 11 having different thicknesses are present in the image forming apparatus 1, even if the apparatus tries to primarily transfer the toner image on all photosensitive drum 11 with high accuracy, the amount of current flowing between the primary transfer roller 31 and the thin photosensitive drum 11 increases. In this case, charges are applied to the toner image transferred from the thin photosensitive drum 11 to the intermediate transfer belt 30 due to a discharge. As a result, a charge distribution of the toner particles that form the toner image on the intermediate transfer belt 30 spreads out. That is, the amount of charges possessed by the individual toner particles that form the toner image varies greatly. Toner particles having large positive charges and toner particles having large negative charges are mixed in the toner image.

Figure 5:
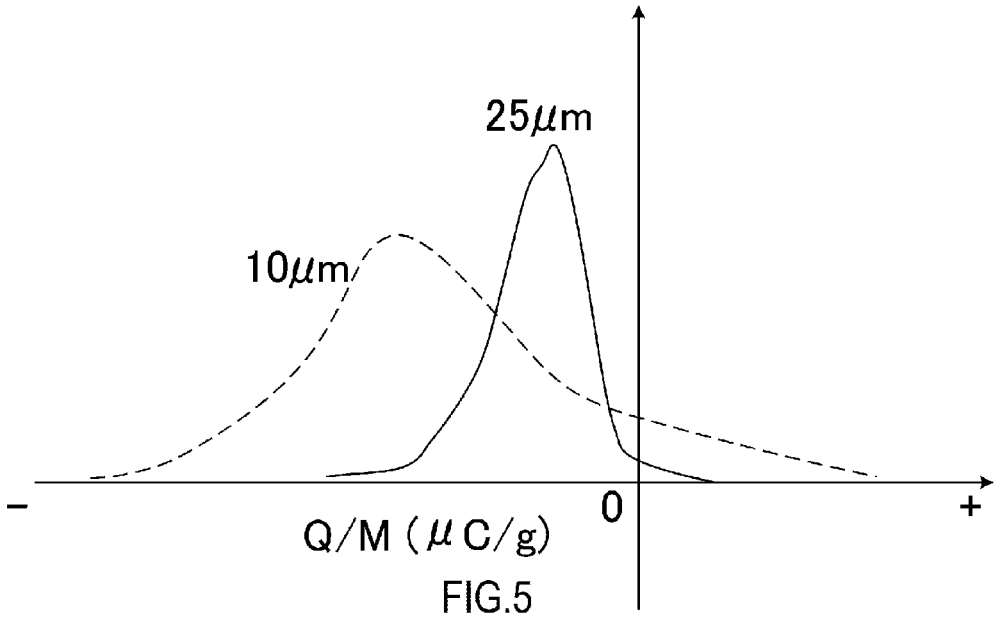
FIG. 5 is a diagram illustrating the charge distribution of toner particles primarily transferred to an intermediate transfer medium.

FIG. 5 is a diagram illustrating a charge distribution of the toner particles primarily transferred to the intermediate transfer belt 30. The horizontal axis of FIG. 5 indicates a toner charge amount Q/M (μC/g). Moreover, the vertical axis indicates the proportion of toner particles present in the toner image. The solid line corresponds to a case where the photosensitive drum 11 has a thickness of 25 μm and a broken line corresponds to a case where the photosensitive drum 11 has a thickness of 10 μm. As illustrated in FIG. 5, when the photosensitive drums 11 have different thicknesses, the charge distribution of secondary transfer residual toner particles on the intermediate transfer belt 30 changes.

In the present embodiment, when the photosensitive drum 11 has a thickness of 25 μm, the potential on the photosensitive drum 11 is set to −150 V and the transfer bias applied to the primary transfer roller 31 is set to +500 V. Moreover, for example, it is assumed that the charge distribution of the secondary transfer residual toner particles spreads out at the transfer position between the photosensitive drum 11Y and the primary transfer roller 31Y. In this case, the charge distribution of the secondary transfer residual toner particles tends to spread further at the transfer position between the photosensitive drums 11M to 11K and the primary transfer rollers 31M to 31K.

Figure 6:
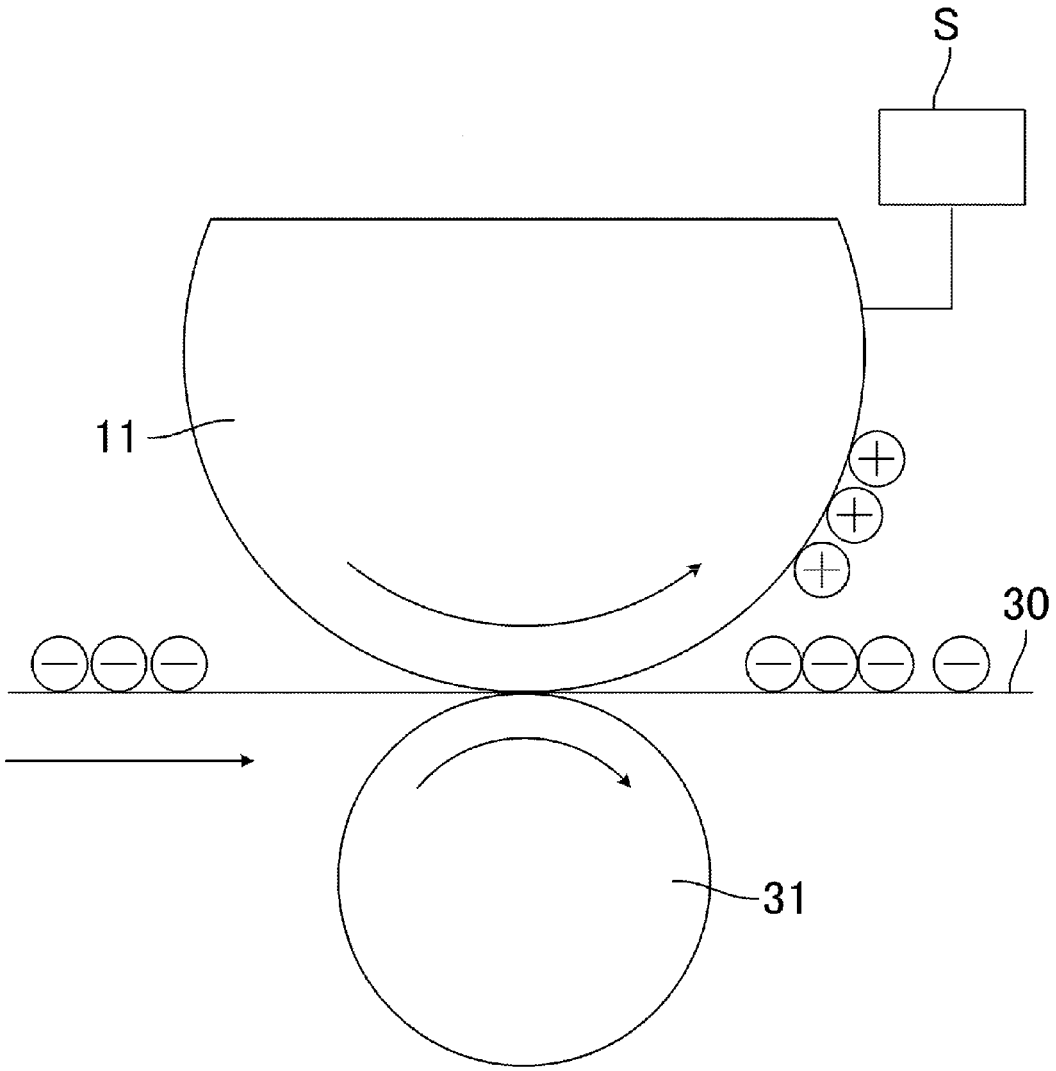
FIG. 6 is a diagram illustrating a transfer position between an intermediate transfer medium and an image bearing member according to the first embodiment.

FIG. 6 is a diagram illustrating the primary transfer position between the photosensitive drum 11 and the intermediate transfer belt 30 according to the first embodiment. As illustrated in FIG. 6, when an image is formed on a recording medium, the toner image primarily transferred from the photosensitive drum 11 to the intermediate transfer belt 30 is conveyed in the moving direction of the intermediate transfer belt 30. In FIG. 6, the toner image is conveyed from left to right. When the photosensitive drum 11 has a thickness of 10 μm, in order to primarily transfer the toner image, it is necessary to set the potential on the photosensitive drum 11 to −500 V and set the transfer bias applied to the primary transfer roller 31 to +500 V.

When the charge distribution of the secondary transfer residual toner particles at the primary transfer position between the thin photosensitive drum 11 and the primary transfer roller 31 spreads out, the charge distribution of the toner particles further spreads due to a discharge at the primary transfer position on the downstream side in the moving direction of the intermediate transfer belt 30. In this manner, when the toner image passes through the primary transfer position on the downstream side in the moving direction of the intermediate transfer belt 30, the charge distribution of the toner particles spreads further due to a discharge. Toner particles having further larger positive charges and toner particles having further larger negative charges are mixed in the toner image.

The toner particles having large positive charges are collected by being transferred back to the photosensitive drum 11 at the primary transfer position located on the downstream side in the moving direction of the intermediate transfer belt 30. However, the toner particles having large negative charges remain on the intermediate transfer belt 30 without being transferred back to the photosensitive drum 11. Moreover, the toner image is secondarily transferred to the recording medium when a transfer bias is applied to the secondary transfer roller 32 at the secondary transfer position between the intermediate transfer belt 30 and the secondary transfer roller 32. However, the toner particles having large negative charges remain on the intermediate transfer belt 30 as secondary transfer residual toner particles.

The secondary transfer residual toner particles remaining on the intermediate transfer belt 30 are sometimes not charged sufficiently by the ICL roller 37. The secondary transfer residual toner particles which have not been charged sufficiently are not transferred back to the photosensitive drum 11 but remain on the intermediate transfer belt 30 together with the toner image primarily transferred from the photosensitive drum 11. Thus, the secondary transfer residual toner particles which have not been collected may be fixed to the recording medium together with the toner image which has been primarily transferred. The secondary transfer residual toner particles which have not been collected are fixed to the recording medium as a so-called ghost image.

<Flow of Controlling Charging Operation of ICL Roller>

Figure 1:
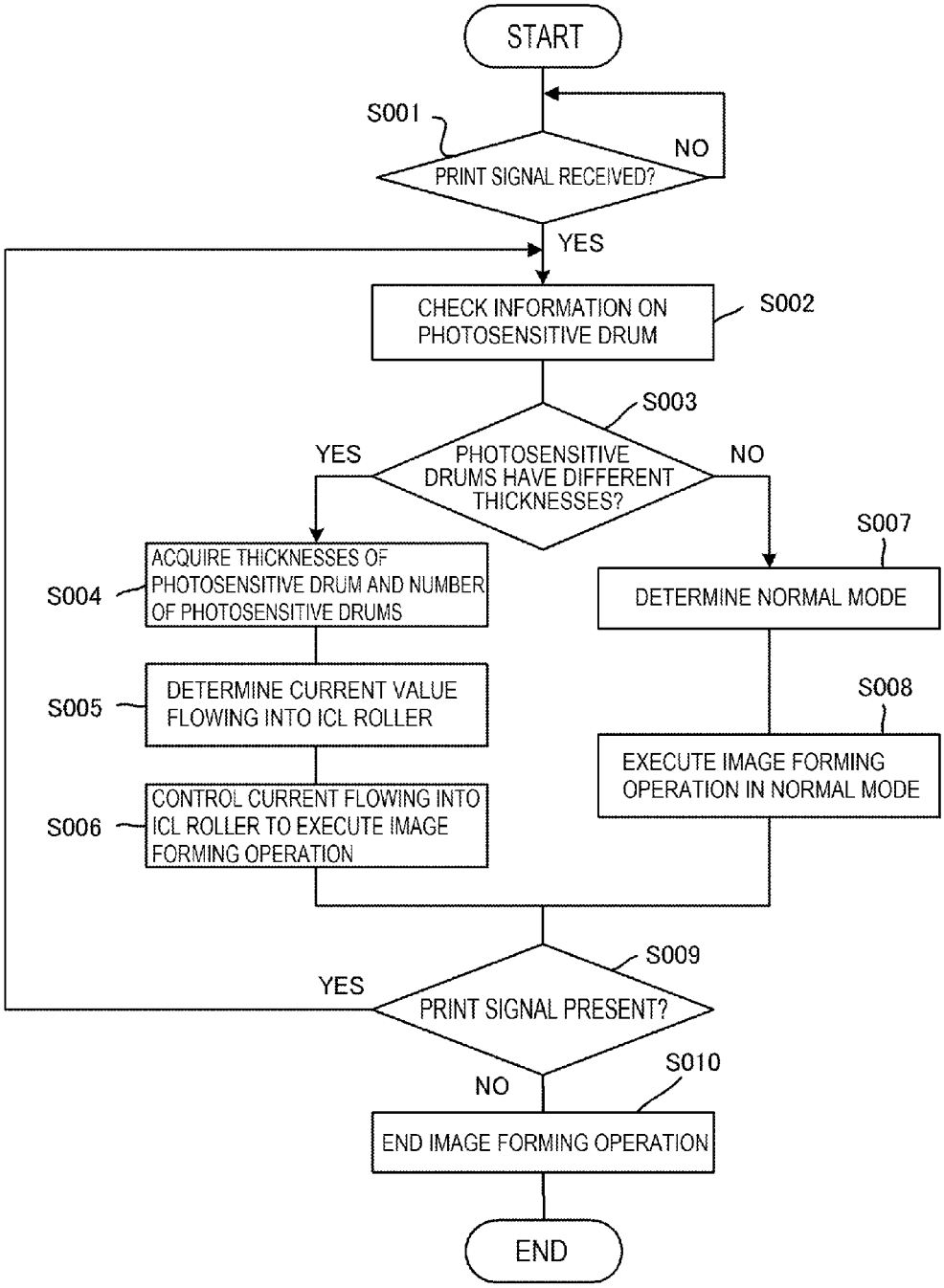
FIG. 1 is a flowchart illustrating the flow of controlling a charging operation according to a first embodiment.

The flow of controlling a bias applied to the ICL roller 37 will be described with reference to FIG. 1. FIG. 1 is a flowchart illustrating the flow of controlling the charging operation of the ICL roller 37. In step S001, when the image information transmitted from the printer controller 200 has been received by the control portion 100 (step S001: YES), the flow proceeds to step S002. On the other hand, when the image information transmitted from the printer controller 200 has not been received by the control portion 100 (step S001: NO), the flow does not proceed to step S002.

In step S002, the control portion 100 checks the information on the photosensitive drum 11 stored in the memory 17 or the like provided in the process cartridge 10. Here, in the present embodiment, the information on the photosensitive drum 11 includes the number of photosensitive drums 11 and the thickness of the photosensitive drum 11. After that, the flow proceeds to step S003. In step S003, when the thicknesses of the plurality of photosensitive drums 11 are different (step S003: YES), the flow proceeds to step S004. On the other hand, in step S003 when the thicknesses of the plurality of photosensitive drums 11 are not different (step S003: NO), the flow proceeds to step S007.

For example, when it is determined in step S003 that the photosensitive drum 11 having a thickness of 10 μm and the photosensitive drum 11 having a thickness of 25 μm are mixed in the image forming apparatus 1, the flow proceeds to step S004. On the other hand, when the thicknesses of all photosensitive drums 11Y to 11K provided in the image forming apparatus 1 are 10 μm, the flow proceeds to step S007. In step S004, the control portion 100 acquires the thicknesses of the photosensitive drums 11 and the number of photosensitive drums 11 from the memory 17. The thicknesses of the photosensitive drums 11 and the number of photosensitive drums 11 are acquired when the program stored in the memory 17 is executed.

In step S005, the control portion 100 determines a voltage applied to the ICL roller 37 based on the acquired thicknesses of the photosensitive drums 11 and the number of photosensitive drums 11. Here, a current value corresponding to the number of photosensitive drums 11 and the thicknesses of the photosensitive drums 11 is stored in advance in the memory 17. Here, the current value is a current value flowing into the ICL roller 37. Moreover, the current value corresponding to the number of photosensitive drums 11 and the thicknesses of the photosensitive drums 11 is such a current value that the service life of the ICL roller 37 does not decrease and that the secondary transfer residual toner particles on the intermediate transfer belt 30 are transferred back to the photosensitive drum 11 with high accuracy. Moreover, the control portion 100 controls the roller high-voltage power source 70 so that a current corresponding to the smallest value of the thicknesses of the photosensitive drums 11Y to 11K flows into the ICL roller 37. When a desired current flows into the ICL roller 37, an appropriate charging state of the secondary transfer residual toner particles on the intermediate transfer belt 30 is created. As a result, the secondary transfer residual toner particles are easily transferred back to the photosensitive drum 11 without sacrificing the service life of the ICL roller 37.

In step S006, the control portion 100 controls the roller high-voltage power source 70 so that the determined voltage is applied to the ICL roller 37. Moreover, the control portion 100 controls a process member such as the process cartridge 10 so that an image forming operation is executed in this state. On the other hand, in step S007, the control portion 100 determines that the image forming operation is to be executed in a normal mode. The normal mode is a mode which is executed when the thicknesses of the photosensitive drums 11Y to 11K are approximately the same. Here, in the normal mode, the control portion 100 controls the voltage applied from the primary transfer bias power source 701 to the primary transfer roller 31 according to the thickness of the photosensitive drum 11. Specifically, a current value corresponding to the thickness of the photosensitive drum 11 is stored in advance in the memory 17, and the control portion 100 controls the roller high-voltage power source 70 so that a current value corresponding to the thickness of the photosensitive drum 11 flows into the ICL roller 37. In this way, the charging state of the toner image primarily transferred is stabilized.

In step S008, the roller high-voltage power source 70 is controlled so that the voltage in the normal mode is applied to the ICL roller 37. Moreover, the control portion 100 controls a process member such as the process cartridge 10 so that the image forming operation is executed in this state. In step S009, when the image forming apparatus 1 has received a subsequent print signal (step S009: YES), the flow proceeds to step S002. On the other hand, in step S009, when the image forming apparatus 1 has not received a subsequent print signal (step S009: NO), the flow proceeds to step S010. In step S010, the image forming operation ends.

In the present embodiment, the conductive brush flowing into the ICL roller 37 in the normal mode is set to 20 μA. A current of 20 μA flows into the ICL roller 37 and the process cartridges 10Y to 10K form toner images. In order to control the current flowing into the ICL roller 37 to be 20 μA constantly, the DC voltage value is set to 1500 V. When the photosensitive drum 11 having a thickness of 10 μm and the photosensitive drum 11 having a thickness of 25 μm are mixed in the image forming apparatus 1, the primary transfer bias power source 701 is controlled so that the current flowing into the ICL roller 37 is 30 μA.

In this way, the present embodiment can suppress the occurrence of image defects. On the other hand, when the photosensitive drums 11 having different thicknesses were mixed in the image forming apparatus 1 and a voltage corresponding to the normal mode was applied to the ICL roller 37, minor image defects (ghost images) were observed. By controlling the voltage applied to the ICL roller 37 in this manner, it is possible to charge the secondary transfer residual toner particles having large negative charges sufficiently to a positive polarity in the course in which the secondary transfer residual toner particles pass through the ICL roller 37. As a result, by controlling the charge amount of the secondary transfer residual toner particles on the intermediate transfer belt 30, it is possible to suppress the occurrence of ghost images. Here, Table 1 illustrates an occurrence state of image defects at respective current values applied to the ICL roller 37. Table 1 illustrates the verification results when the photosensitive drum 11 having a thickness of 10 μm and the photosensitive drum 11 having a thickness of 25 μm are mixed in the image forming apparatus 1.

TABLE 1

| BIAS APPLIED TO ICL | 0 | 10K | 20K | 30K | 40K | 50K |
|---|---|---|---|---|---|---|
| 20 μA | Δ | Δ | Δ | Δ | Δ | Δ |
| 30 μA | ○ | ○ | ○ | ○ | ○ | ○ |
| 40 μA | ○ | ○ | ○ | ○ | ○ | X |

In Table 1, "Δ" indicates that minor image defects (ghost images) have occurred. Moreover, "X" indicates that the ICL roller 37 has deteriorated due to energization. When the photosensitive drum 11 having a thickness of 10 μm and the photosensitive drum 11 having a thickness of 25 μm were mixed in the image forming apparatus 1 and the current flowing into the ICL roller 37 was controlled to 30 μA, image defects were not observed even when the number of printed sheets reached 50K sheets (50000 sheets).

On the other hand, when the current flowing into the ICL roller 37 was controlled to 20 μA, minor image defects were observed regardless of the number of printed sheets. Moreover, when the current flowing into the ICL roller 37 was controlled to 40 μA, the ICL roller 37 deteriorated due to energization when the number of printed sheets reached 50K sheets (50000 sheets). Thus, when the photosensitive drum 11 having a thickness of 10 μm and the photosensitive drum 11 having a thickness of 25 μm are mixed in the image forming apparatus 1, it is preferable to control the current flowing into the ICL roller 37 to 30 μA.

As described above, in the present embodiment, the bias applied to the ICL roller 37 is controlled based on the thickness of the photosensitive drum 11. In this way, even when the thicknesses of the plurality of photosensitive drums 11 are different, it is possible to collect the secondary transfer residual toner particles on the intermediate transfer belt 30 using the photosensitive drum 11 with high accuracy without sacrificing the service life of the ICL roller 37.

Moreover, when photosensitive drums 11 having different thicknesses are included in the plurality of photosensitive drums 11, the charging operation of the ICL roller 37 is controlled based on the number of photosensitive drums 11 and the thicknesses of the photosensitive drums 11. In this way, it is possible to suppress the secondary transfer residual toner particles from being charged insufficiently due to the different thicknesses of the photosensitive drums 11.

(Second Embodiment)

An image forming apparatus according to a second embodiment has the same configuration as the configuration of the image forming apparatus 1 according to the first embodiment. Unlike the first embodiment, in the second embodiment, the thickness of the photosensitive drum 11 is estimated (measured and predicted) based on the potential of the surface of the photosensitive drum 11. Moreover, the charging operation of the ICL roller 37 is controlled based on an estimated value (measurement information) of the thickness of the photosensitive drum 11. Here, in the second embodiment, the portions having the same functions as those of the first embodiment will be denoted by the same reference numerals, and the description thereof will not be provided.

<Flow of Controlling Charging Operation of ICL Roller>

Figure 7:
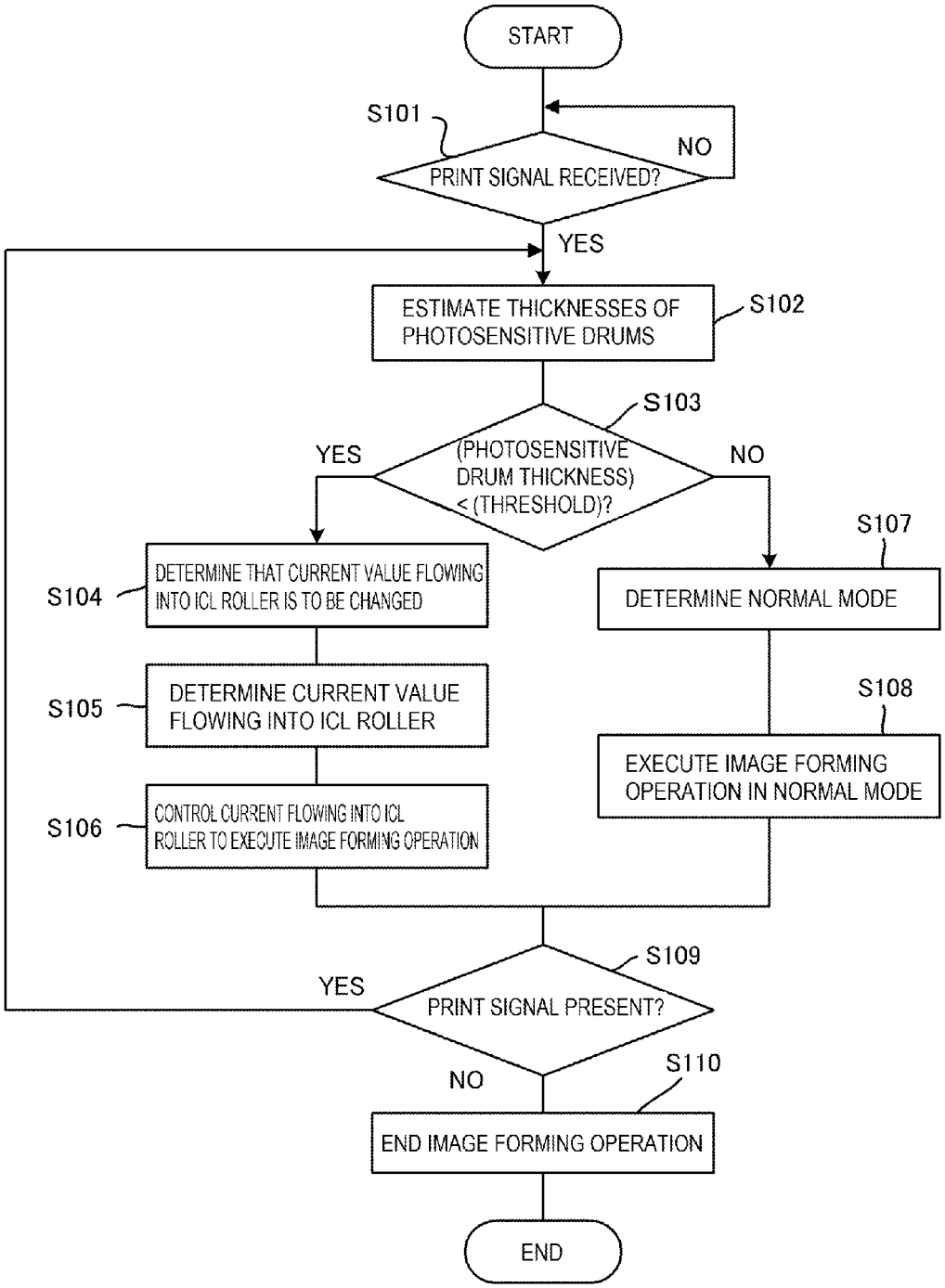
FIG. 7 is a flowchart illustrating the flow of controlling a charging operation according to a second embodiment.

FIG. 7 is a flowchart illustrating the flow of controlling the charging operation of the ICL roller 37 according to the second embodiment. In step S101, when the print signal transmitted from the printer controller 200 has been received by the control portion 100 (step S101: YES), the flow proceeds to step S102. On the other hand, when the print signal transmitted from the printer controller 200 has not been received by the control portion 100 (step S101: NO), the flow does not proceed to step S102.

In step S102, the control portion 100 estimates the thickness of the photosensitive drum 11 based on the potential of the surface of the photosensitive drum 11. The potential on the photosensitive drum 11 changes depending on the use history of the photosensitive drum 11. Here, a method of estimating the thickness of the photosensitive drum 11 will be described. A correspondence between the potential of the surface of the photosensitive drum 11 and the thickness of the photosensitive drum 11 is stored in the memory 17 provided in the process cartridge 10. The control portion 100 estimates the thickness of the photosensitive drum 11 by checking the correspondence stored in the memory 17 and the potential of the surface of the photosensitive drum 11 detected by a sensor S (a measurement portion). The sensor S is a sensor capable of detecting the potential of the surface of the photosensitive drum 11. The thickness of the photosensitive drum 11 is estimated when the program stored in the memory 17 is executed.

The thickness of the photosensitive drum 11 can be also estimated based on the number (the number of passing sheets) of sheets P on which an image is formed, the rotation speed of the photosensitive drum 11, and the like. When the thickness of the photosensitive drum 11 is estimated based on the number of passing sheets, a sensor that counts the number of passing sheets is used as the sensor S. Moreover, when the thickness of the photosensitive drum 11 is estimated based on the rotation speed of the photosensitive drum 11, a sensor that counts the rotation speed of the photosensitive drum 11 is used as the sensor S. In this case, an initial value of the thickness of the photosensitive drum 11 is stored in advance in the memory 17. A correspondence between a decrease in the thickness of the photosensitive drum 11 and the number of passing sheets (or the rotation speed of the photosensitive drum 11) is stored in the memory 17, and a decrease in the thickness of the photosensitive drum 11 is calculated based on the correspondence with the number of passing sheets (or the rotation speed) counted by the sensor S. Moreover, the thickness of the photosensitive drum 11 is calculated by subtracting the decrease in the thickness from the initial value of the thickness of the photosensitive drum 11.

Subsequently, in step S103, when the estimated value of the thickness of at least one of the photosensitive drums 11Y to 11K is smaller than a threshold T (step S103: YES), the flow proceeds to step S104. On the other hand, in step S103, when the estimated value of the thickness of the photosensitive drum 11 is not smaller than the threshold T (step S103: NO), the flow proceeds to step S107. In step S104, the control portion 100 determines that the current value flowing into the ICL roller 37 is to be changed.

In step S105, the control portion 100 determines the current value flowing into the ICL roller 37 based on the estimated value of the thickness of the photosensitive drum 11. Here, a current value corresponding to the estimated value of the thickness of the photosensitive drum 11 is stored in advance in the memory 17. Specifically, a threshold for classifying (sorting) the estimated value of the thickness of the photosensitive drum 11 and a current value corresponding to each class of the thickness of the photosensitive drum 11 are stored in the memory 17. Here, the current value is a current value flowing into the ICL roller 37. Moreover, the current value corresponding to the estimated value of the thickness of the photosensitive drum 11 is such a current value that the service life of the ICL roller 37 does not decrease and that the secondary transfer residual toner particles on the intermediate transfer belt 30 are transferred back to the photosensitive drum 11 with high accuracy.

The control portion 100 acquires a smallest value of the thicknesses of the plurality of photosensitive drums 11Y to 11K and acquires a current value corresponding to the class to which the smallest value of the thickness belongs from the memory 17. Moreover, the control portion 100 controls the roller high-voltage power source 70 so that a current having the acquired value flows into the ICL roller 37. When a desired current flows into the ICL roller 37, an appropriate charging state of the secondary transfer residual toner particles on the intermediate transfer belt 30 is created. As a result, the secondary transfer residual toner particles are easily transferred back to the photosensitive drum 11 without sacrificing the service life of the ICL roller 37.

In step S106, the control portion 100 controls the roller high-voltage power source 70 so that the determined current flows into the ICL roller 37. Moreover, the control portion 100 controls a process member such as the process cartridge 10 so that an image forming operation is executed in this state. On the other hand, in step S107, the control portion 100 determines that the image forming operation is to be executed in a normal mode. In step S108, the roller high-voltage power source 70 is controlled so that the voltage in the normal mode is applied to the ICL roller 37. Moreover, the control portion 100 controls a process member such as the process cartridge 10 so that the image forming operation is executed in this state.

In step S109, when the image forming apparatus 1 has received a subsequent print signal (step S109: YES), the flow proceeds to step S102. On the other hand, in step S109, when the image forming apparatus 1 has not received a subsequent print signal (step S109: NO), the flow proceeds to step S110. In step S110, the estimated value of the thickness of the photosensitive drum 11 and the current value flowing into the ICL roller 37 are written to the memory 17. After that, the image forming operation ends.

In the second embodiment, the voltage applied to the ICL roller 37 in the normal mode is set similarly to the first embodiment. Moreover, the threshold T of the thickness of the photosensitive drum 11 is set to 11 μm. That is, when the thickness of at least one of the photosensitive drums 11Y to 11K is smaller than 11 μm, the voltage applied to the ICL roller 37 is changed. In the second embodiment, when the thickness of at least one of the photosensitive drums 11Y to 11K is smaller than the threshold, a current of 30 μA flows into the ICL roller 37. In this way, in the present embodiment, it is possible to suppress the occurrence of image defects (ghost images) similarly to the first embodiment. The occurrence state of image defects show the same tendency as illustrated in Table 1 of the first embodiment.

As described above, in the second embodiment, similarly to the first embodiment, it is possible to collect the secondary transfer residual toner particles on the intermediate transfer belt 30 using the photosensitive drum 11 with high accuracy without sacrificing the service life of the ICL roller 37.

Moreover, in the second embodiment, the charging state of the secondary transfer residual toner particles is changed based on the thickness of the photosensitive drum 11. In this way, it is possible to collect the secondary transfer residual toner particles on the intermediate transfer belt 30 using the photosensitive drum 11 with high accuracy even when the photosensitive drum 11 has deteriorated.

(Third Embodiment)

An image forming apparatus according to a third embodiment has the same configuration as the configuration of the image forming apparatus 1 according to the first embodiment. Unlike the first embodiment, in the third embodiment, the charging state of the secondary transfer residual toner particles is estimated based on the estimated value of the thickness of the photosensitive drum 11 and the arrangement order of the photosensitive drum 11. Moreover, the charging operation of the ICL roller 37 is controlled based on the estimated charging state of the secondary transfer residual toner particles. Here, in the third embodiment, the portions having the same functions as those of the first embodiment will be denoted by the same reference numerals, and the description thereof will not be provided.

<Flow of Controlling Charging Operation of ICL Roller>

Figure 8:
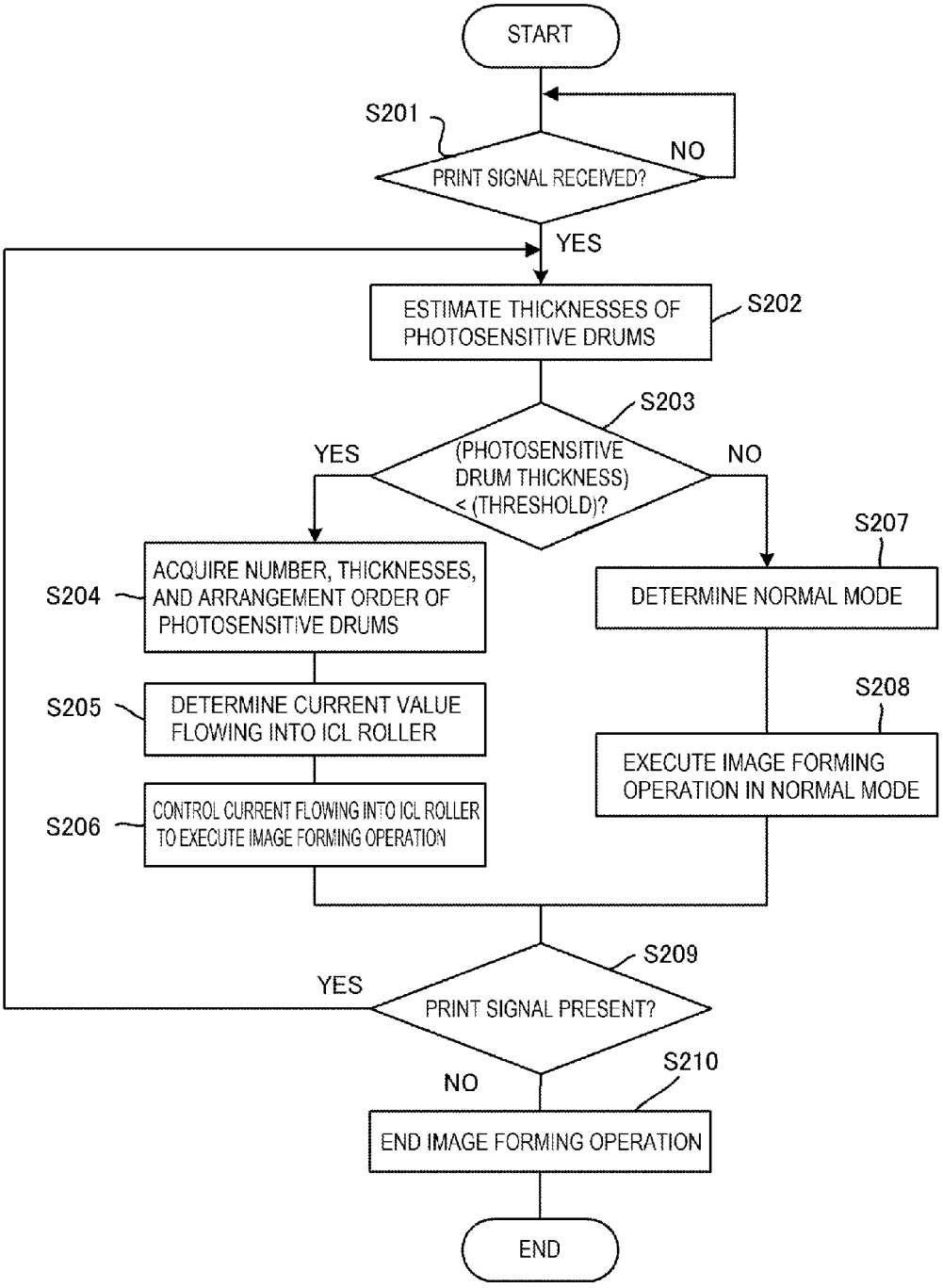
FIG. 8 is a flowchart illustrating the flow of controlling a charging operation according to a third embodiment.

FIG. 8 is a flowchart illustrating the flow of controlling the charging operation of the ICL roller 37 according to the third embodiment. In step S201, when the print signal transmitted from the printer controller 200 has been received by the control portion 100 (step S201: YES), the flow proceeds to step S202. On the other hand, when the print signal transmitted from the printer controller 200 has not been received by the control portion 100 (step S201: NO), the flow does not proceed to step S202. In step S202, the control portion 100 estimates the thickness of the photosensitive drum 11 based on the potential of the surface of the photosensitive drum 11. A method of estimating the thickness of the photosensitive drum 11 is the same as that of the second embodiment.

Subsequently, in step S203, when the estimated value of the thickness of at least one of the photosensitive drums 11Y to 11K is smaller than the threshold T (step S203: YES), the flow proceeds to step S204. On the other hand, in step S203, when the estimated value of the thickness of the photosensitive drum 11 is not smaller than the threshold T (step S203: NO), the flow proceeds to step S207.

Here, in the third embodiment, the number of photosensitive drums 11, the estimated values of the thicknesses of the photosensitive drums 11, the arrangement order of the photosensitive drums 11, and the current values corresponding to these values are stored in advance in the memory 17. Here, the current value stored in the memory 17 is such a current value that the secondary transfer residual toner particles are easily transferred back to the photosensitive drum 11. Moreover, the arrangement order of the photosensitive drum 11 is an arrangement order of the photosensitive drum 11 in the moving direction of the intermediate transfer belt 30. In step S204, the control portion 100 acquires the number of photosensitive drums 11, the thicknesses of the photosensitive drums 11, and the arrangement order of the photosensitive drums 11 from the memory 17.

Subsequently, in step S205, the control portion 100 determines a current value flowing into the ICL roller 37 based on the number of photosensitive drums 11, the estimated values of the thicknesses of the photosensitive drums 11, and the arrangement order of the photosensitive drums 11. Here, the current value corresponding to the number of photosensitive drums 11, the estimated value of the thickness of the photosensitive drum 11, and the arrangement order of the photosensitive drum 11 is stored in advance in the memory 17. Here, the current value is a current value flowing into the ICL roller 37. Moreover, the current value stored in advance in the memory 17 is such a current value that the service life of the ICL roller 37 does not decrease and that the secondary transfer residual toner particles on the intermediate transfer belt 30 are transferred back to the photosensitive drum 11 with high accuracy. A predetermined voltage is applied to the ICL roller 37 so that such a current flows into the ICL roller 37. When a desired current flows into the ICL roller 37, an appropriate charging state of the secondary transfer residual toner particles on the intermediate transfer belt 30 is created. As a result, the secondary transfer residual toner particles are easily transferred back to the photosensitive drum 11 without sacrificing the service life of the ICL roller 37.

In step S206, the control portion 100 controls the roller high-voltage power source 70 so that the determined current flows into the ICL roller 37. Moreover, the control portion 100 controls a process member such as the process cartridge 10 so that an image forming operation is executed in this state. On the other hand, in step S207, the control portion 100 determines that the image forming operation is to be executed in a normal mode. In step S208, the roller high-voltage power source 70 is controlled so that the voltage in the normal mode is applied to the ICL roller 37. Moreover, the control portion 100 controls a process member such as the process cartridge 10 so that the image forming operation is executed in this state.

In step S209, when the image forming apparatus 1 has received a subsequent print signal (step S209: YES), the flow proceeds to step S202. On the other hand, in step S209, when the image forming apparatus 1 has not received a subsequent print signal (step S209: NO), the flow proceeds to step S210. In step S210, the estimated value of the thickness of the photosensitive drum 11 and the current value flowing into the ICL roller 37 are written to the memory 17. After that, the image forming operation ends.

In the third embodiment, the voltage applied to the ICL roller 37 in the normal mode is set similarly to the first and second embodiments. Moreover, the threshold T of the thickness of the photosensitive drum 11 is set to 11 μm. That is, when the thickness of at least one of the photosensitive drums 11Y to 11K is smaller than 11 μm, the voltage applied to the ICL roller 37 is changed. Table 2 illustrates the current value flowing into the ICL roller 37 when two photosensitive drums 11 having a smaller thickness than the threshold are present in the photosensitive drums 11Y to 11K.

Here, a "station having thickness of threshold T or smaller" in Table 2 is the process cartridge 10 having the photosensitive drum 11 of which the thickness is smaller than the threshold and is the kind of process cartridge 10 positioned on the most upstream side in the moving direction of the intermediate transfer belt 30. "Ye" is a process cartridge that forms a yellow toner image. "Mg" is a process cartridge that forms a magenta toner image. Moreover, "Cy" is a process cartridge that forms a cyan toner image.

TABLE 2

| STATION HAVING THICKNESS OF THRESHOLD T OR SMALLER | OUTPUT VALUE OF BIAS APPLIED TO ICL |
|---|---|
| Ye | 33 μA |
| Mg | 30 μA |
| Cy | 28 μA |

The environment in which the image forming apparatus 1 is used is a normal environment (temperature environment, humidity environment, and the like). As illustrated in Table 2, when another process cartridge 10 having the photosensitive drum 11 of which the thickness is smaller than the threshold is present on the downstream side of the process cartridges "Ye" to "Cy" in the moving direction of the intermediate transfer belt 30, the "output value of bias applied to ICL" changes. Here, the "output value of the bias applied to ICL" is a current flowing into the ICL roller 37 and is such a current value that all secondary transfer residual toner particles can be transferred back to the photosensitive drum 11.

First, when primary transfer is performed, the toner image on the intermediate transfer belt 30 is charged with negative charges due to a discharge. Moreover, the toner image is further charged with negative charges in the course of passing between the photosensitive drum 11 and the primary transfer roller 31 on the downstream side in the moving direction of the intermediate transfer belt 30. Due to this, in the third embodiment, the current flowing into the ICL roller 37 is changed according to the arrangement order of the photosensitive drums 11 in the moving direction of the intermediate transfer belt 30 and the number of photosensitive drums 11. In this way, the present embodiment can suppress the occurrence of image defects (ghost images) similarly to the first and second embodiments. The occurrence state of image defects showed the same tendency as illustrated in Table 1 of the first embodiment.

As described above, in the third embodiment, similarly to the first embodiment, it is possible to collect the secondary transfer residual toner particles on the intermediate transfer belt 30 using the photosensitive drum 11 with high accuracy without sacrificing the service life of the ICL roller 37.

Moreover, in the third embodiment, the current flowing into the ICL roller 37 is changed when the estimated value of the thickness of at least one of the plurality of photosensitive drums 11 is smaller than the threshold. Specifically, the current flowing into the ICL roller 37 is changed based on the estimated values of the thicknesses of the photosensitive drums 11, the number of photosensitive drums 11, and the arrangement order of the photosensitive drums 11. In this way, it is possible to transfer the secondary transfer residual toner particles back to the photosensitive drum 11 efficiently even when the charging state of the secondary transfer residual toner particles changes according to the order of photosensitive drums 11.

In the first embodiment, although the same bias is applied to the primary transfer rollers 31Y to 31K, the present invention is not necessarily limited to this. For example, the same bias may be applied to two or three primary transfer rollers 31. When the same bias is applied to the plurality of primary transfer rollers 31, the advantages of the first embodiment can be obtained. Moreover, the primary transfer member may not be the primary transfer roller and may not be located at a position facing the image bearing member at a primary transfer portion. For example, only one primary transfer member may be disposed at the center. Moreover, primary transfer may be performed by allowing a current to flow from the secondary transfer roller to the intermediate transfer belt which is an intermediate transfer medium. In this case, the primary transfer roller which is the primary transfer member described above may not be provided.

Moreover, in the respective embodiments, although the roller high-voltage power source 70 is constant-current-controlled so that the current flowing into the ICL roller 37 is constant, the present invention is not necessarily limited to this. For example, the current flowing into the ICL roller 37 may be changed based on the use environment (temperature environment, humidity environment, and the like) of the image forming apparatus 1. In the present embodiment, the power source is a transformer of a circuit.

In the present embodiment, although a contact-charging-type ICL roller is used as the charging member, the present invention is not limited to this but a corona-discharging-type roller which is a non-contact-type roller may be used depending on a configuration.

Moreover, in the first embodiment, only two types of photosensitive drums which include the photosensitive drum 11 having a thickness of 10 μm and the photosensitive drum 11 having a thickness of 25 μm are provided in the image forming apparatus 1. However, the present invention is not necessarily limited to this. The photosensitive drum 11 may have a thickness other than these thicknesses.

Moreover, in the respective embodiments, the current flowing into the ICL roller 37 is constant-current-controlled by applying a DC voltage to the ICL roller 37. However, the present invention is not necessarily limited to this. For example, the voltage applied to the ICL roller 37 may be a voltage in which an AC component (AC voltage) is superimposed on a DC component (DC voltage). In this case, secondary transfer residual toner particles may be scattered by allowing the secondary transfer residual toner particle to reciprocate between the ICL roller 37 and the intermediate transfer belt 30 according to the electric field generated around the ICL roller 37.

In the second and third embodiments, the thickness of the photosensitive drum 11 is estimated after the image forming apparatus 1 receives the print signal. Moreover, the current flowing into the ICL roller 37 is controlled based on the estimated value of the thickness of the photosensitive drum 11. However, the present invention is not necessarily limited to this. For example, the current flowing into the ICL roller 37 may be controlled whenever an image is printed on 1000 pages of sheet P. In this way, the image forming operation can be executed quickly.

Moreover, the memory 17 provided in the process cartridge 10 is used as a means for storing information. However, the present invention is not necessarily limited to this. For example, the means for storing information may be a hard disk drive (HDD) provided in the main body of the image forming apparatus 1.

Moreover, in the respective embodiments, the information on the image bearing member includes the type of the image bearing member, the rotation speed of the image bearing member, the thickness and the sensitivity of the photosensitive layer of the image bearing member, changes in these items of information with time, and the like, and at least one of these items of information is stored in the storage portion. Naturally, the storage portion may store the plurality of items of information and the storage portion may additionally store information which is updated sequentially.

In the respective embodiments, the output value of the bias applied to the ICL roller 37 may be changed gradually according to the thickness of the photosensitive drum 11. For example, the current flowing into the ICL roller 37 may be set to 30 μA when the thickness of the photosensitive drum 11 is between 15 μm and 20 μm, and the current flowing into the ICL roller 37 may be set to 25 μA when the thickness of the photosensitive drum 11 is between 20 μm and 25 μm.

In the respective embodiments, the bias applied to the ICL roller 37 may be determined based on the sensitivity of the photosensitive drum 11. For example, the sensitivity of the photosensitive drum 11 may be classified into low sensitivity, medium sensitivity, and high sensitivity based on the potential of the surface of the photosensitive drum 11, and a bias corresponding to each of the sensitivity levels may be applied to the ICL roller 37.

Moreover, in the respective embodiments, the bias applied to the ICL roller 37 may be determined based on the rotation speed of the photosensitive drum 11. For example, the correspondence between the rotation speed of the photosensitive drum 11 and the thickness of the photosensitive drum 11 is stored in the memory 17, and the thickness of the photosensitive drum 11 may be obtained based on the correspondence with the rotation speed of the photosensitive drum 11.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-182746, filed on Sep. 16, 2015, which is hereby incorporated by reference herein in its entirety.

What is claimed is:

1. An image forming apparatus comprising:

a plurality of image bearing members, each on which a developer image is formed;

an intermediate transfer medium to which the developer image on the image bearing member is primarily transferred;

a transfer member that secondarily transfers the developer image, primarily transferred to the intermediate transfer medium, to a recording medium;

a charging member that charges residual developer remaining on the intermediate transfer medium after the developer image is secondarily transferred from the intermediate transfer medium to the recording medium;

a storage portion that stores information about a film thickness of each of the plurality of image bearing members; and a control portion that controls a bias voltage applied to the charging member based on the stored information about the film thickness of an image bearing member having a smallest film thickness value among the plurality of image bearing members, to charge the residual developer remaining on the intermediate transfer medium before the residual developer is transferred from the intermediate transfer medium to the plurality of image bearing members.

2. The image forming apparatus according to claim 1, wherein the control portion determines the image bearing member having the smallest film thickness value based on the information about the film thickness of each of the plurality of image bearing members stored in the storage portion.

3. The image forming apparatus according to claim 1, wherein the information about the film thickness of each of the plurality of image bearing members is predicted based on at least one of a type information of each of the plurality of image bearing members or a rotation speed information of each of the plurality of image bearing members.

4. The image forming apparatus according to claim 3, wherein the information about the film thickness of each of the plurality image bearing members is also predicted based on an arrangement order information of the plurality of image bearing members in a moving direction of a surface of the intermediate transfer medium.

5. The image forming apparatus according to claim 1, comprising:

a plurality of cartridges, each including one of the plurality of image bearing members and each detachably attached to a main body of the image forming apparatus; and a plurality of ones of the storage portion, each provided on one of the plurality of cartridges and each storing the information about the film thickness of one of the plurality of image bearing members.

6. The image forming apparatus according to claim 1 further including:

a measurement portion that measures a potential on each of the plurality of image bearing members, wherein the information about the film thickness of each of the plurality of image bearing members is acquired based on the potential measured by the measurement portion.

7. The image forming apparatus according to claim 3, wherein the information about the film thickness of each of the plurality of image bearing members is predicted based on the potential of the respective image bearing member changing with a use history of the respective image bearing member.

8. The image forming apparatus according to claim 7, wherein the information about the film thickness of each of the plurality of image bearing members is also predicted based on sensitivity information of each of the plurality of image bearing members.

9. The image forming apparatus according to claim 1, wherein:

a current flowing into the charging member is constant-current-controlled, and the control portion controls the bias voltage applied to the charging member so that an output value of the bias voltage changes gradually according to the film thickness of the image bearing member having the smallest film thickness value.

10. The image forming apparatus according to claim 9, wherein the bias voltage applied to the charging member contains superposed DC voltage and AC voltage.

11. The image forming apparatus according to claim 5, wherein a first image bearing member and a second image bearing member, among the plurality of image bearing members, are different types.

12. The image forming apparatus according to claim 5, further comprising:

a plurality of primary transfer members that primarily transfers the developer image on the plurality of image bearing members to the intermediate transfer medium, wherein the control portion applies a bias voltage to at least two or more of the plurality of primary transfer members from a same power source.

13. The image forming apparatus according to claim 1, wherein the image bearing member is provided in a process cartridge that is detachably attached to a main body of the image forming apparatus.

14. The image forming apparatus according to claim 1, further comprising:

a cleaning device that collects developer remaining on each of the plurality of image bearing members after the developer image on the respective image bearing member is primarily transferred to the intermediate transfer medium, wherein each cleaning device collects the residual developer charged by the charging member after the residual developer is transferred from the intermediate transfer medium to the respective image bearing member.

15. The image forming apparatus according to claim 5, wherein:

the plurality of image bearing members include:

a first image bearing member for bearing a first developer image; and a second image bearing member for bearing a second developer image;

the intermediate transfer medium primarily transfers the first and the second developer images on the first and the second image bearing members;

the transfer member secondarily transfers the first and the second developer images primarily transferred to the intermediate transfer medium, to the recording medium;

the charging member charges the residual developer remaining on the intermediate transfer medium after the first and the second developer image are secondarily transferred from the intermediate transfer medium to the recording medium;

the plurality of storage portions include:

a first storage portion that stores information about the film thickness of the first image bearing member; and a second storage portion that stores information about the film thickness of the second image bearing member, and the control portion controls the bias voltage applied to the charging member based on the information stored in the first and the second storage portions, to charge the residual developer remaining on the intermediate transfer medium before the residual developer is transferred from the intermediate transfer medium to the first or second image bearing member.

* * * * *